United States Patent [19]

Fang

[11] Patent Number: 4,950,008

[45] Date of Patent: Aug. 21, 1990

[54] AUXILIARY LOCK WITH AN EXTENSIBLE DEVICE

[75] Inventor: Yau C. Fang, Chiayi, Taiwan

[73] Assignee: Posse Lock Manufacturing Co., Ltd., Chiayi, Taiwan

[21] Appl. No.: 428,051

[22] Filed: Oct. 27, 1989

[51] Int. Cl.[5] ..... E05B 9/06

[52] U.S. Cl. ..... 292/337; 292/DIG. 74

[58] Field of Search ..... 292/337, DIG. 60, DIG. 74

[56] References Cited

U.S. PATENT DOCUMENTS

| | | | |
|---|---|---|---|
| 4,372,594 | 2/1983 | Gater | 292/337 |
| 4,602,490 | 7/1986 | Glass et al. | 292/337 X |
| 4,662,665 | 5/1987 | Lin | 292/167 |
| 4,664,433 | 5/1987 | Solovieff | 292/337 |
| 4,725,086 | 2/1988 | Shen | 292/337 |
| 4,752,090 | 6/1988 | Lin | 292/337 X |
| 4,759,576 | 7/1988 | Ching | 292/337 |
| 4,767,140 | 8/1988 | Lin | 292/337 |

*Primary Examiner*—Lloyd A. Gall

*Attorney, Agent, or Firm*—Fleit, Jacobson, Cohn, Price, Holman & Stern

[57] ABSTRACT

An auxiliary lock is disclosed on which it is possible to change its length by turning and moving a combining plate to cause an extensible shell to turn and move around a cylinder so that a projection in the extensible shell may extend into one of two positioning holes in the cylinder to form the short length or in the other positioning hole to form the long length. At the same time, a connecting pin in a deadbolt moves in a U-shaped slot and a reversed U-shaped slot in a moving plate operable by a mechanism in the combining plate.

3 Claims, 4 Drawing Sheets

AUXILIARY LOCK WITH AN EXTENSIBLE DEVICE

BACKGROUND OF THE INVENTION

The U.S. Pat. No. 4,662,665 has a structure wherein the distance of the faceplate and the rotating shell can be changed by the pin 742 of the linking plate 64 selectably hooking in one of the two notches 211 or 212 in the arm 21. The U.S. Pat. No. 4,664,433 has a structure, wherein the length of the latch is changed by the bolt guide pin 100 protruding and turning in the flat end portions 128 set in the bolt assembly 36. And the U.S. Pat. No. 4,752,090 has a structure, wherein the length of the lock is changed by the pin assembly on the dead bolt engaging the helical track formed on the post.

SUMMARY OF THE INVENTION

The object of this invention is to provide an auxiliary lock adjustable in two kinds of length having a different structure from those above mentioned.

The auxiliary lock adjustable in two kinds of length in accordance with the present invention comprises a cylinder, an extensible shell, a combining plate, a moving plate and a dead bolt as the main components.

The cylinder is provided with a faceplate, two positioning holes and a slot, and its outer surface is surrounded by the extensible shell, which is able to turn and move on the cylinder and which includes a projection in one of the two positioning holes and movable along the slot from one of its ends to the other in order that the lock may be changed from the short length to the long length.

The extensible shell is provided with an L-shaped slot adjacent to the projection to furnish it with a flexibility so that it can be moved in the cylinder slot and to extend into one of the positioning holes, and with a double cross-shaped opening in a rear wall or bottom for connecting the shell with the combining plate for mutual movement.

The combining plate has the same structure as that in a conventional auxiliary lock and also is connected with the moving plate to operate it axially.

The moving plate, connected with and operated by the combining plate, is provided with a round tube section at the front having a U-shaped slot and a reversed U-shaped slot located correspondingly at respective opposite sides of the vertical center line of the moving plate. Both of the U-shaped and reversed U-shaped slots have vertical end sections connected by a horizontal section, for receiving a pin which corrects the moving plate with the dead bolt.

The dead botl is movably contained in the cylinder and has a hollow interior which receives the front tube section of the moving plate. The pin which is used to correct the dead bolt with the moving plate, is selectively positionable in respective ones of the vertical end section of the U-shaped and reversed U-shaped slots, and is movable along the horizontal sections of said two slots to change its position from one vertical end section to the other of said two slots, and thereby change the lock from the short length, and vice versa to the long length.

The length between the two vertical end sections of both of said U-shaped and reversed U-shaped slots in the moving plate is the same as the length between the two positioning holes in the cylinder.

BRIEF DESCRIPTION OF THE DRAWINGS

This invention will now be described in detail with reference to accompanying drawings wherein.

DETAILED DESCRIPTION OF THE INVENTION

Figure 1:
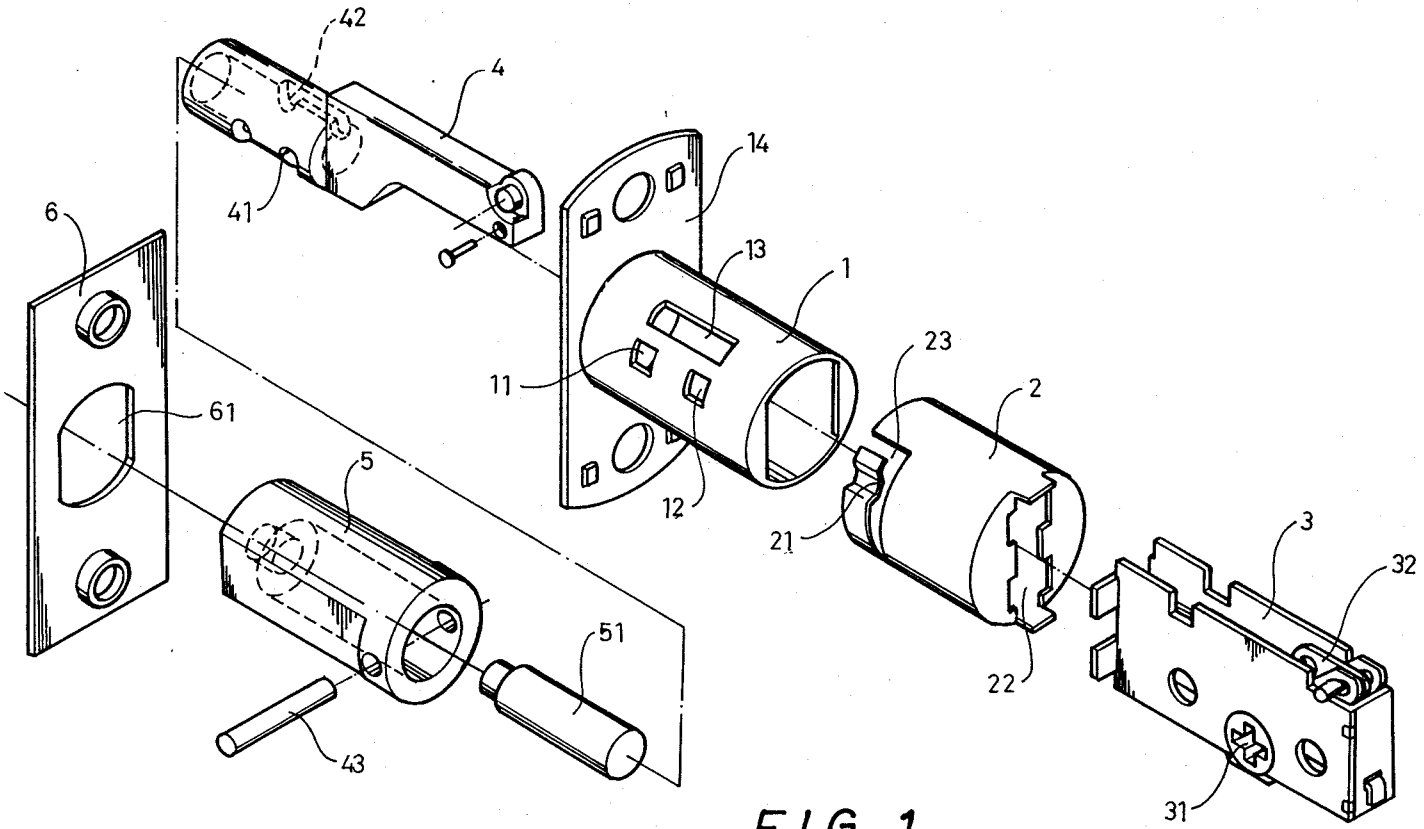
FIG. 1 is an exploded perspective view of the present invention.

Referring to FIG. 1, this auxiliary lock according to the present invention comprises a cylinder 1, an extensible shell 2, a combining plate 3, a moving plate 4 and a dead bolt 5 as the main components.

The cylinder 1 contains the dead bolt 5 in such a way that the dead bolt 5 can extend out of or retract in the cylinder 1, and the extensible shell 2 fits around the cylinder 1. The cylinder 1 is provided with two positioning holes 11 and 12 and a longitudinal receiving slot 13 for an inner projection 21 in the extensible shell 2, the projection 21 either selectably extending into one of the holes 11 and 12 or moving lengthwise along and in the slot 13. In addition, the cylinder 1 has a faceplate 14 connectable to a cover 6.

The extensible shell 2 fits around and can move lengthwise along the outer surface of the cylinder 1, and is provided with a double cross-shaped opening 22 at its bottom for, into which the combining plate 3 can be hooked to connect the shell and the combining plate with each other. An L-shaped slot 23 is provided adjacent to the projection 21 so that it can furnish it with elasticity to move radially in and out, and so that the projection 21 can smoothly enter and thereby move along the slot 13 and then extend into the hole 11 or 12 by turning the extensible shell 2.

The combining plate 3 has the same structure as that in a conventional auxiliary lock, utilizing a shaft 31 with a cross-shaped groove and connected to a connecting plate 32 for operating the moving plate 4.

The moving plate 4, which is connected with and moved by the connecting plate 32, is provided with a front round tube section having a U-shaped slot 41 on one side and a reversed U-shaped slot 42 located on an opposite side in a position corresponding to the slot 41. More specifically, vertical end sections of the slots 41 and 42, and respective horizontal slot sections which interconnect the end sections and which are diametrically opposite one another, as shown in FIGS. 1–5, are separately located at respective opposite sides of the moving plate 4, and a pin 43 connects the moving plate 4 with the dead bolt 5.

For this purpose, the dead bolt 5 is contained and can move in the cylinder 1 and has a hollow interior which receives the front round tube section of the moving plate 4 so that the pin 43 can extend crosswise through apertures in the dead bolt 5 and the slots 41 and 42 in the moving plate 4 to connect them together. A reinforcing bar 51 is placed in the hollow interior of the dead bolts in advance of the pin 43 to prevent the dead bolt 5 from being saved off. When the moving plate 4 turns around relative to the dead bolt 5, and then is moved longitudinally, the pin 43 moves along the horizontal sections of the slots 41 and 42, and stops at one of both of the vertical end sections of the slots 41 and 42, to form the short or the long length of the lock. The turning distance of the pin 43 in both of the slots 41 and 42 is as long as the turning distance of the extensible shell 2 relative to the cylinder 1. In other words, as the projection 21 moves from the hole 11 to the slot 13, and then moves horizontally along the slot 13 to the hole 12, so the pin 43 moves in the slots 41 and 42 in the same way and distance.

The cover 6 is fixed with the faceplate 14 to prevent the moving plate 4, the dead bolt 5 and the reinforcing bar 51 from falling out of the cylinder 1 after those components are assembled therein. The cover 6 is provided with a dead bolt hole 61 through which the dead bolt 5 can extend outward.

Figure 2:
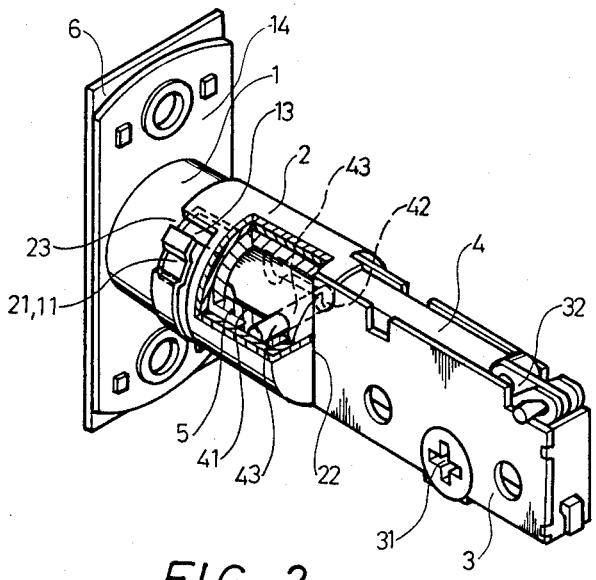
FIG. 2 is a perspective view, partially broken away, of the auxiliary lock adjusted in the short length in accordance with the present invention.

FIG. 2 shows the lock set in the short length, with the projection 21 extending into the positioning hole 11, and the pin 43 disposed in the right vertical end sections of both of the slots 41 and 42.

Figure 3:
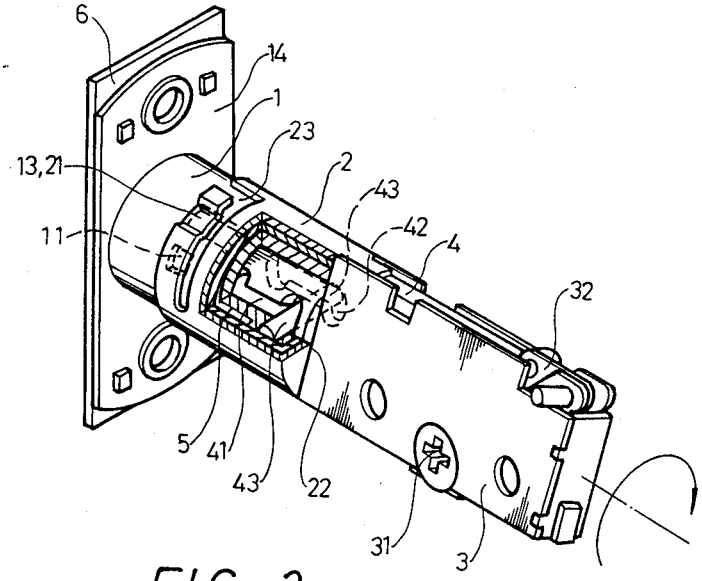
FIG. 3 is a perspective view of, partially broken away, showing an initial step in adjusting of the auxiliary lock from the short length into the long length in accordance with the present invention.
Figure 4:
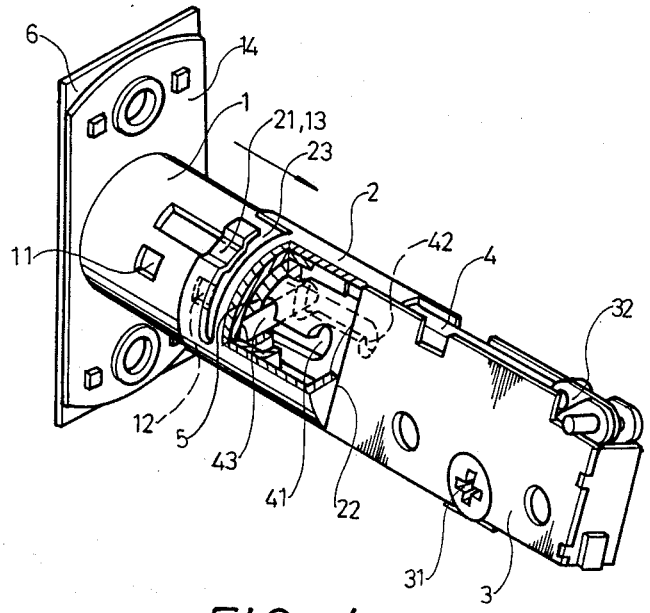
FIG. 4 is another perspective view partially broken away, further showing the auxiliary lock being adjusted to the long length in accordance with the present invention.
Figure 5:
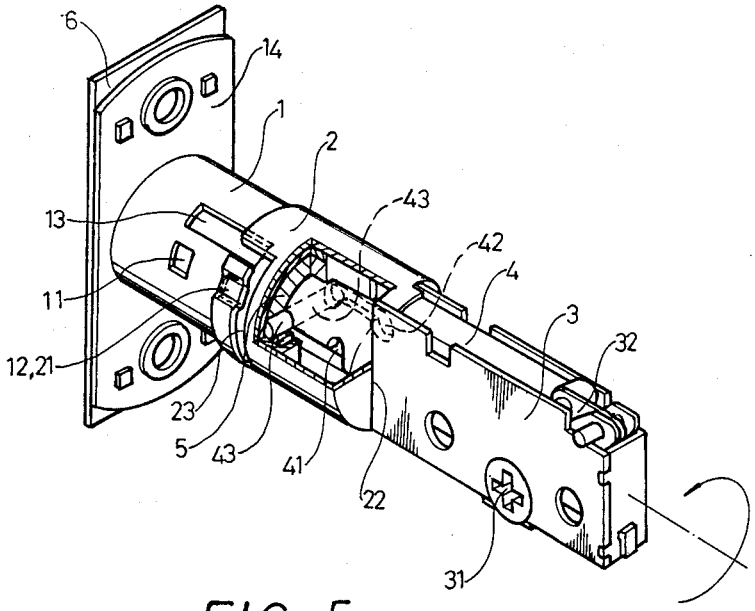
FIG. 5 is a perspective view, partially broken away, of the auxiliary lock adjusted to the long length in accordance with the present invention.

Referring to FIG. 3, when the lock is to be changed from the short length to the long length, turing the combining plate 3 clockwise will move the projection 21 to the slot 13, and the pin 43 will be moved in the right vertical end sections of the slots 41 and 42 to the right-hand ends of the slot horizontal sections. At this time, if the combining plate 3 is pulled backward, the pin 43 will be moved to the left-hand left ends of the horizontal sections of the slots 41 and 42 as shown in FIG. 4. Then the combining plate 3 has to be turned counted clockwise so as to make the projection 21 move into the positioning hole 12 and the pin 43 move to the ends of the left vertical end sections of the slots 41 and 42. Thus, the lock is changed to the long length.

Figure 6:
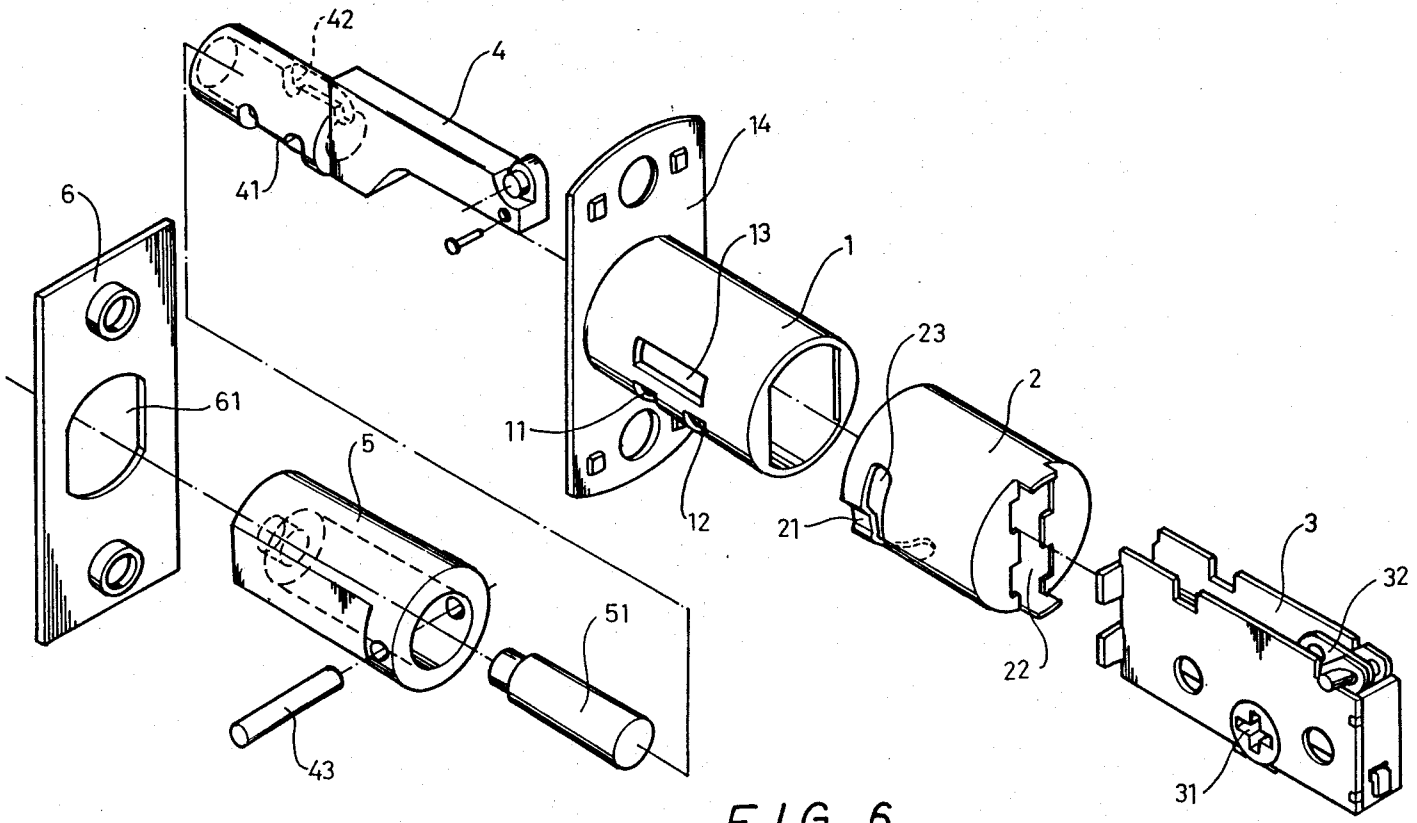
FIG. 6 is an exploded perspective view of another embodiment in accordance with the present invention.

Additionally, the other embodiment of the auxiliary lock in accordance with the present invention is shown in FIG. 6. This example has almost the same structure as described above except that the slot 13 is merely a recess for the projection 21 to slide in and the L-shaped slot 23 is merely straight instead of L-shaped, and still giving flexibility to the projection 21.

In summary, the auxiliary lock in accordance with the invention can be changed from the short length to the long length or vice versa by merely turning the combining plate 3, in a very simple manner.

What is claimed is:

1. An auxiliary lock with an extensible portion, comprising:

a cylinder provided with two positioning holes and a longitudinal slot, and having its outer circumferential surface surrounded by an extensible shell;

said extensible shell being provided with an inner projection which can selectably extend into one of the two positioning holes in the cylinder and move lengthwise along the slot in the cylinder by turning the extensible shell and causing relative axial movement between the shell and the cylinder;

a combining plate assembled with a rear section of the extensible shell and provided with a connecting plate connected with a moving plate;

said moving plate also being connected with a dead bolt and being provided with a front round tube section which is received in the dead bolt, said front round tube section having a U-shaped slot and a reversed U-shaped slot for receiving respective portions of a pin;

said dead bolt being movably contained inside the cylinder and having a hollow interior which receives the front round tube section of the moving plate, with said pin extending crosswise through a rear end of the dead bolt and said U-shaped slot and said reversed U-shaped slot in the front round tube section of the moving plate; and said pin connecting the dead bolt and the moving plate, and being capable of movement from one end of both the U-shaped slot and the reversed U-shaped slot to the other ends of both of the slots when the projection in the extensible shell moves from one of the two positioning holes to the other in adjusting the lock from a short length to a long length or reversely.

2. An auxiliary lock as claimed in claim 1, wherein the front round tube section of the moving plate is provided with the U-shaped slot and the reversed U-shaped slot facing each other and located on respective opposite sides of the moving plate.

3. An auxiliary lock as claimed in claim 1, wherein the moving distance of the projection of the extensible shell in relation to the cylinder is as long as the moving distance of the pin connecting the dead bolt with the moving plate in both the U-shaped and the reversed U-shaped slots.

* * * * *